US008490557B2

(12) United States Patent
Kwak

(10) Patent No.: US 8,490,557 B2
(45) Date of Patent: Jul. 23, 2013

(54) BALANCE MAINTAINING EQUIPMENT FOR FLOATING BODY

(75) Inventor: Byung-Man Kwak, Daejeon (KR)

(73) Assignee: Korea Advanced Institute of Science and Technology (KR)

( * ) Notice: Subject to any disclaimer, the term of this patent is extended or adjusted under 35 U.S.C. 154(b) by 122 days.

(21) Appl. No.: 13/062,814

(22) PCT Filed: Dec. 30, 2009

(86) PCT No.: PCT/KR2009/007990

§ 371 (c)(1),
(2), (4) Date: Mar. 8, 2011

(87) PCT Pub. No.: WO2011/019122

PCT Pub. Date: Feb. 17, 2011

(65) Prior Publication Data

US 2011/0155034 A1 Jun. 30, 2011

(30) Foreign Application Priority Data

Aug. 12, 2009 (KR) ..... 10-2009-0074376

(51) Int. Cl.
*B63B 39/02* (2006.01)

(52) U.S. Cl.
USPC ..... 114/122; 114/124

(58) Field of Classification Search
USPC ..... 114/122, 124
See application file for complete search history.

(56) References Cited

U.S. PATENT DOCUMENTS

| | | | | |
|---|---|---|---|---|
| 1,575,239 | A * | 3/1926 | Walker | 74/603 |
| 2,030,701 | A * | 2/1936 | Johnson | 92/145 |
| 2,995,103 | A * | 8/1961 | Heinrich et al. | 114/40 |
| 4,748,927 | A | 6/1988 | Bujacich | |
| 5,628,267 | A | 5/1997 | Hoshio et al. | |
| 5,787,832 | A * | 8/1998 | Spinka | 114/123 |
| 2005/0076726 | A1 | 4/2005 | Akers | |

FOREIGN PATENT DOCUMENTS

| | | |
|---|---|---|
| JP | 08244682 | 9/1996 |
| JP | 09277984 | 10/1997 |
| JP | 10157690 | 6/1998 |
| KR | 10-0586024 B1 | 5/2006 |
| KR | 2020070001117 | 10/2007 |
| WO | 2009044998 | 4/2009 |

* cited by examiner

*Primary Examiner* — Stephen Avila
(74) *Attorney, Agent, or Firm* — Bacon & Thomas, PLLC

(57) ABSTRACT

A balance maintaining equipment for a floating body includes a driving device for rotating a driving shaft; a first eccentric rotating body positioned at one side of the driving device and connected to the driving shaft to rotate around the driving shaft by the rotation thereof; and a second eccentric rotating body positioned at the other side of the driving device and connected to the driving shaft to rotate around the driving shaft by the rotation thereof, while having a phase difference of 180 degrees from the rotation of the first eccentric rotating body. The balance maintaining equipment generates the moment in the opposite direction to the roll of the floating body. Furthermore, when the roll period of the floating body is changed, the balance maintaining equipment varies the angular velocity of the driving shaft to interwork with the roll period of the floating body.

14 Claims, 7 Drawing Sheets

BALANCE MAINTAINING EQUIPMENT FOR FLOATING BODY

TECHNICAL FIELD

The present invention relates to a balance maintaining equipment for a floating body, and more particularly, to a balance maintaining equipment capable of maintaining the balance of a floating body which floats in fluid, for example, a mobile harbor which is moored on the sea remote from land to load and unload cargos.

BACKGROUND OF THE INVENTION

A case in which the balance of a floating body floating in fluid should be maintained to guarantee the stability of the floating body exists in a variety of industrial fields. For example, the balance of a vessel or mobile harbor needs to be maintained to guarantee the stability of the vessel or mobile harbor.

For example, marine transportation using a vessel as means for transporting goods to a remote place consumes a smaller amount of energy and requires a smaller transportation cost than other transportation means. Therefore, a large percentage of international trades rely on the marine transportation.

Recently, in order to improve the efficiency of marine transportation using a container vessel, a large-sized vessel has been used. In this case, the volume of traffic may be increased to secure the economical efficiency of the transportation. Accordingly, a demand for a harbor including a mooring system capable of mooring a large vessel and a loading/unloading facility is more and more increasing.

However, the number of harbors capable of mooring a large container vessel is limited in most countries. Furthermore, the construction of such a harbor not only requires a lot of costs, but also needs a wide place. In addition, the construction of a large harbor may cause traffic congestion around the construction site or have a large effect upon the surrounding environment, for example, resulting in the ruin of the seashore environment. Therefore, there are many limitations in constructing a large harbor.

Accordingly, the technology on a mobile harbor which is a floating body capable of performing an operation in a state in which it is moored not at a quay wall of a harbor but on the sea remote from land has been developed.

DISCLOSURE

Technical Problem

Such a floating body is inevitably rolled by an external or internal cause in fluid. Such a roll occurring in the floating body, for example, a roll which is continuously caused by an influence of winds, surges, or tides in a mobile harbor may have a serious effect upon the stability of the floating body. It is, therefore, an object of the present invention to provide a balance maintaining equipment for a floating body capable of reducing or removing the roll in order to stably perform an operation.

Technical Solution

In accordance with an aspect of the present invention, there is provided a balance maintaining equipment for a floating body, includes: a driving device for rotating a driving shaft; a first eccentric rotating body positioned at one side of the driving device, connected to the driving shaft, and rotated around the driving shaft by the rotation of the driving shaft; and a second eccentric rotating body positioned at the other side of the driving device, connected to the driving shaft, and rotated around the driving shaft by the rotation of the driving shaft, while having a phase difference of 180 degrees from the rotation of the first eccentric rotating body.

Further, the driving shaft is formed to expand or contract in a direction from the one side to the other side or from the other side to the one side.

Further, the shafts in the respective stages include a spline shaft or a shaft having a cross-sectional surface formed in a polygonal shape.

Further, when the driving shaft is expanded or contracted, the length of the driving shaft expanded or contacted in the direction of the one side is equal to that of the driving shaft expanded or contracted in the direction of the other side.

In the present invention, the balance maintaining equipment further includes a first frame having a rotation region of the first eccentric rotating body, supporting the one-side of the driving shaft, and moved together with the shaft of the driving shaft when the driving shaft is expanded or contracted; and a second frame having a rotation region of the second eccentric rotating body, supporting the other-side of the driving shaft, and moved together with the shaft of the driving shaft when the driving shaft is expanded or contracted.

In the present invention, the balance maintaining equipment further includes guide rails for guiding the first and second frames, respectively, wherein the first and second frames are formed to move along the guide rails, respectively.

Further, the first and second eccentric rotating bodies include first and second rotating shafts having one ends coupled to the driving shaft, and first and second mass bodies coupled to the other ends of the first and second rotating shafts, respectively.

Further, each of the first and second rotating shafts is formed by combining multi-stage shafts having different diameters wherein a shaft in each stage is expanded and contracted.

In accordance with another aspect of the present invention, there is provided a balance maintaining equipment for a floating body, includes: a first driving device for rotating a first driving shaft; a first eccentric rotating body positioned at one side of the first driving device, having one end connected to the first driving shaft, and rotated around the first driving shaft by the rotation of the first driving shaft; a second driving device for rotating a second driving shaft; and a second eccentric rotating body positioned at the other side of the second driving device, having one end connected to the second driving shaft, and rotated around the second driving shaft by the rotation of the second driving shaft, while having a phase difference of 180 degrees from the rotation of the first eccentric rotating body.

In the present invention, the balance maintaining equipment further includes: a first frame for housing and supporting the first driving device and the first driving shaft; a second frame for housing and supporting the second driving device and the second driving shaft; and a transferring device for transferring the first and second frames in a direction perpendicular to a plane along which the first and second eccentric rotating shafts are rotated.

Further, the balance maintaining equipment further includes guide rails for guiding the first and second frames, respectively, wherein the first and second frames are moved along the guide rails, respectively.

In the present invention, when the first and second driving devices are transferred by the transferring device, the transfer distances of the first and second driving devices are equal to each other.

Further, the first and second eccentric rotating bodies include, first and second rotating shafts having one ends coupled to the first and second driving shafts, respectively, and first and second mass bodies coupled to the other ends of the first and second rotating shafts, respectively.

In the present invention, the driving device may include a motor, a gear body, and a decelerator.

Advantageous Effects

The balance maintaining equipment for the floating body in accordance with the embodiments of the present invention may reduce or remove a roll of the floating body floating in fluid. For example, in a mobile harbor performing an operation while floating on the sea, it is possible to reduce or remove a roll of the mobile harbor caused by winds, surges, or tides.

Furthermore, as the roll of the floating body is reduced or removed, the stability of the floating body may be guaranteed, and facilities and operators inside the floating body may be protected. For example, as a roll of a mobile harbor is reduced or removed, the operation of the mobile harbor may be stably performed, and the stability of the operators working in the mobile harbor may be guaranteed.

Furthermore, internal or external changes which are roll causes of the floating body may be actively dealt with. For example, although changes in winds, surges, or tides occur on the sea, the balance maintaining equipment may actively control the changes to maintain the balance of the mobile harbor.

BEST MODE FOR THE INVENTION

Hereinafter, a balance maintaining equipment for a floating body according to embodiments of the present invention will be described in detail with reference to the accompanying drawings. The following description of the embodiments is explanatory of the balance maintaining equipment for a floating body and not restrictive of the scope of the present invention.

A balance maintaining equipment for a floating body in accordance with embodiments of the present invention may be applied to all bodies floating in fluid. In the following embodiments of the present invention, a floating body on the sea, for example, a mobile harbor will be specifically described. In the following embodiments of the present invention, the mobile harbor will be taken as a representative example of bodies floating in fluid, and the floating body may include a mobile harbor, a vessel, and a partial unit such as an apparatus floating in fluid.

Figure 1:
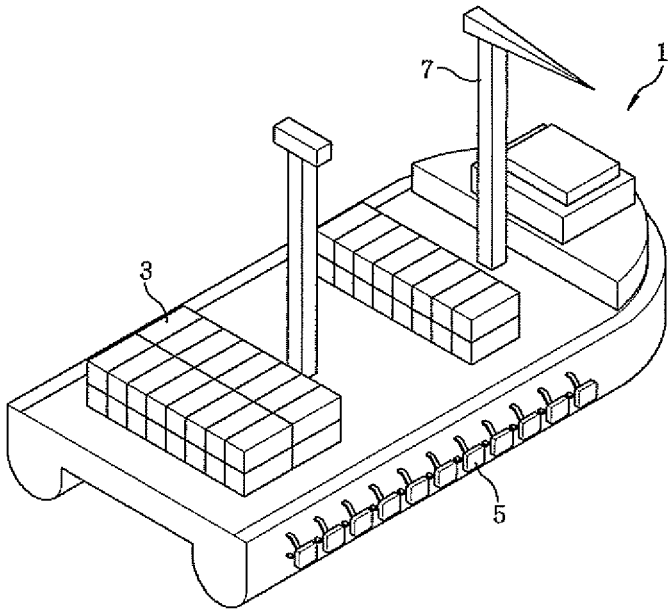
FIG. 1 is a conceptual diagram of a mobile harbor.
Figure 2:
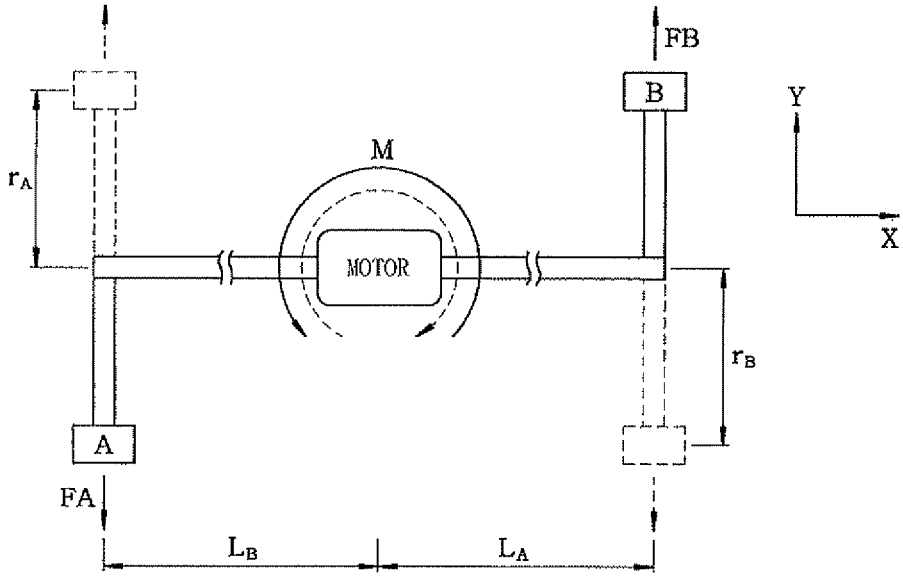
FIG. 2 is a conceptual diagram illustrating the principle of a balance maintaining equipment in a floating body in accordance with embodiments of the present invention.

FIG. 1 is a conceptual diagram of a mobile harbor as an example of a floating body. FIG. 2 is a conceptual diagram illustrating the principle of a balance maintaining equipment in the floating body in accordance with the present invention. FIGS. 3 to 8 are diagrams illustrating specific embodiments of the present invention.

Referring to FIG. 1, the mobile harbor 1 is available to load and unload cargos 3 on the sea. That is, the mobile harbor 1 is docked with a vessel (not illustrated) such as a container vessel through a docking system 5 on the sea, and loads the cargos 3 on the vessel or unloads cargos from the vessel by using a loading and unloading system 7.

At this time, since the loading and unloading operations of the cargos 3 are performed on the sea, the mobile harbor 1 may roll during the loading and unloading operations. Due to the rolling, there occur difficulties in performing the loading and unloading operations. Therefore, the mobile harbor 1 needs a balance maintaining equipment for maintaining the balance of the mobile harbor 1.

There may be a variety of factors to occur the rolling of the mobile harbor 1 on the sea. Among other things, representative factors may include surges, tides, or winds, which may form their own waves. For example, the wave of the surge may be set to a surge period of five seconds, more or less in design of a general vessel. Such a period may be set differently depending on the structures of vessels and the operation environments of the vessels. In the embodiments of the present invention, the period may be set differently depending on the operation position of the mobile harbor 1 or the like.

As shown in FIG. 2, if mass bodies A and B are rotated with respect to the rotational axis of an X-axis direction in conformity with the roll period of the floating body, for example, the roll period of the mobile harbor 1 caused by surges, tides, or winds having a predetermined period, and if both centrifugal forces FA and FB caused by the rotations of the mass bodies A and B are controlled to be equalized to each other, a moment M in a direction perpendicular to an X-Y plane is then generated in the mobile harbor 1 by the mass bodies A and B.

Here, the magnitude of the moment M may be calculated as expressed below.

$$M=m_A r_A \omega^2_A L_A+m_B r_B \omega^2_B L_B,\ m_A r_A \omega^2_A=m_B r_B \omega^2_B$$

where, m represents the mass of the mass bodies, r represents a radius of gyration, ω represents an angular velocity, L represents a distance from the center, and lower subscripts A and B represents the respective mass bodies.

At this time, the moment M has a corresponding period and direction depending on the rotation periods of the mass bodies A and B. If the period of the moment M is rendered to adapt to the roll period of the floating body caused by rolling factors such as surges, tides or winds, but to produce a moment by which the moment M is balanced in the opposite direction to the rolling of the floating body, it is possible to substantially reduce or remove the rolling of the floating body.

Furthermore, when the intensity or period of a rolling factor is changed or when the weight distribution of the floating body is changed by an internal cause of the floating body, for example, when the weight distribution of the mobile harbor 1 is changed by loading or unloading the cargos 3 (shown in FIG. 1) on or from the mobile harbor 1, the generation or generation period of the moment M needs to be changed. In this case, the generation period and magnitude of the moment M may be varied by changing rA, rB, ωA, ωB, LA, or LB.

To be more specific, when it is desired to increase the generation of the moment M, some or all of rA, rB, ωA, ωB, LA and LB may be increased, and when it is desired to decrease the generation of the moment M, some or all of rA, rB, ωA, ωB, LA and LB may be decreased, to thereby control the generation of a necessary moment M.

It will be understood that only some variables among the variables may be varied, and the other variables may be previously fixed.

Meanwhile, when the floating body is provided with the balance maintaining equipment based on such a principle to generate the moment M in the opposite direction to the rolling of the floating body, a moment other than the moment generated in the direction perpendicular to the X-Y plane, for example, a Y-direction moment may be generated by the rotations of the mass bodies A and B. In order to offset the moment, a pair of balance maintaining equipments may be provided on the floating body so as to be set in parallel to each other. However, the following descriptions will be focused on any one of the balance maintaining equipments of the floating body which are provided in a pair. Furthermore, in the following embodiments of the present invention, it is assumed that a pair of balance maintaining equipments may be provided on the floating body.

Figure 3:
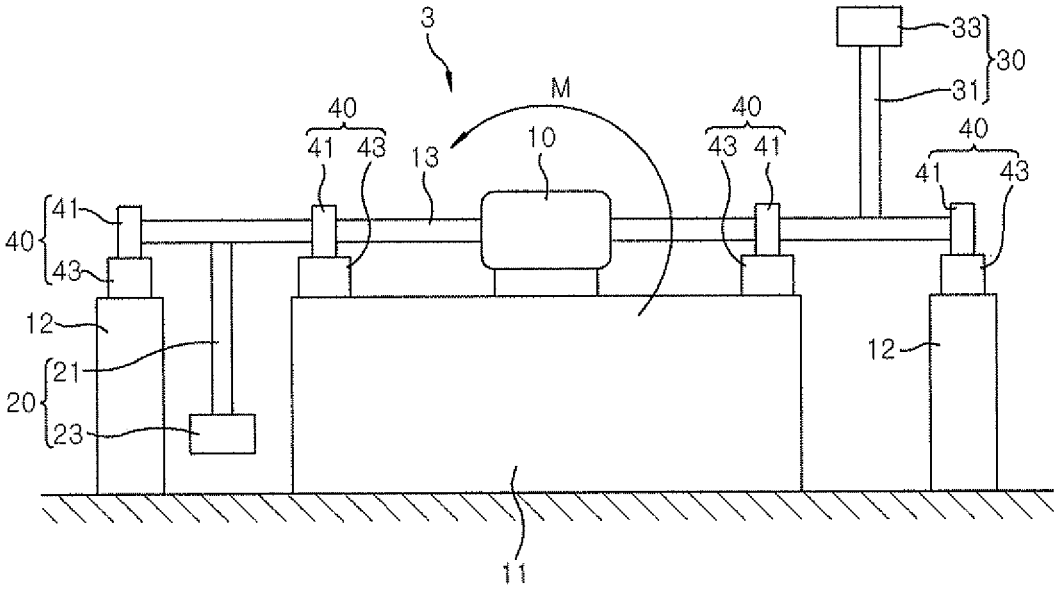
FIG. 3 is a front view of a balance maintaining equipment for a floating body in accordance with a first embodiment of the present invention.

Referring to FIG. 3, a balance maintaining equipment 3 of the floating body in accordance with a first embodiment of the present invention will be specifically described.

The balance maintaining equipment 3 of the floating body in accordance with the first embodiment includes a driving device 10 to rotate a driving shaft 13, a first eccentric rotating body 20, and a second eccentric rotating body 30. The first eccentric rotating body 20 is positioned at one side of the driving device 10, has an end connected to the driving shaft 13, and rotated around the driving shaft 13 by the rotation of the driving shaft 13. The second eccentric body 30 is positioned at the other side of the driving device 10, has an end connected to the driving shaft 13, and is rotated around the driving shaft 13 while having a phase difference of 180 degrees from the rotation of the first eccentric rotating body 20. Here, the first and second eccentric rotating bodies 20 and 30 are fixed to the shaft 13 such that they have a phase difference of 180 degrees.

First, the driving device 10 serves to rotate the driving shaft 13, and may be formed on a platform 11 in order to secure the rotation region of the first and second eccentric rotating bodies 20 and 30. At this time, the platform 11 is formed to have a larger height than the length of the first and second eccentric bodies 20 and 30. The driving device 10 may include a motor and a gear body which are not illustrated. Any devices may be used as the driving device 10, as long as the devices may rotate the driving shaft 13. Furthermore, the driving device 10 may include a decelerator (not illustrated), and the decelerator serves to reduce the number of rotations by the motor or the like.

The first and second eccentric bodies 20 and 30 may be provided at both sides of the driving device 10.

Here, the first and second eccentric rotating bodies 20 and 30 include the entire eccentric rotating bodies which rotate around the driving shaft 13. When a plurality of eccentric rotating bodies rotating around the driving shaft 13 are provided, the first and second eccentric rotating bodies 20 and 30 may include the plurality of eccentric rotating bodies. Furthermore, when the first eccentric rotating body 20 includes a first rotating shaft 21 and a first mass body 23, they are called the first eccentric rotating body 20. When the second eccentric rotating body 30 includes a second rotating shaft 31 and a second mass body 33, they are called the second eccentric rotating body 30.

The first eccentric rotating body 20 is positioned at one side of the driving device 10, and the second eccentric rotating body 30 is positioned at the other side of the driving device 10, that is, in the opposite side of the first eccentric rotating body 20. Both of the first and second eccentric rotating bodies 20 and 30 are connected to the driving shaft, and connected to the driving shaft while having a phase difference of 180 degrees. Furthermore, the first and second eccentric rotating bodies 20 and 30 may be connected perpendicular to the driving shaft 13.

Furthermore, the driving shaft 13 may be supported by a plurality of supports 40, and each of the supports 40 may include a bearing portion 41 coupled to the driving shaft 13 and a bearing support 43. The supports 40 may support both sides of the driving shaft 13 connected to the first or second eccentric rotating body 20 or 30 on the basis of the first or second eccentric rotating body 20 or 30. That is, at one side of the driving device 10, the supports 40 are provided at both sides of the first eccentric rotating body 20. One of the supports 40 may be positioned on the platform 11, and the other may be positioned on a separate platform 12. The supports 40 may also be positioned at both sides of the second eccentric body 30. Accordingly, the first and second eccentric rotating bodies 20 and 30 may be stably rotated.

The balance maintaining equipment 3 of the floating body in accordance with the first embodiment of the present invention may be positioned inside or on the floating body, for example, the mobile harbor 1. The balance maintaining equipment 3 may be positioned to face the longitudinal direction or widthwise direction of the floating body 1 depending on the roll direction of the floating body 1. In accordance with the first embodiment of the present invention, a pair of balance maintaining equipments 3 may be provided in the longitudinal direction and the widthwise direction of the floating body 1, respectively, or may be provided in parallel to each of the longitudinal direction and the widthwise direction of the floating body 1. When the balance maintaining equipments 3 are positioned in the longitudinal direction and/or the widthwise direction, they may be positioned in the center of the longitudinal direction and/or the widthwise direction of the floating body 1.

The driving shaft 13 may have strength enough to endure the centrifugal forces generated by the rotations of the first and second eccentric rotating bodies 20 and 30.

The operation of the balance maintaining equipment 3 of the floating body in accordance with the first embodiment of the present invention will be described as follows.

When a roll or a prediction of roll of the floating body 1 by a roll factor, for example, winds, surges, or tides is detected, the driving device 10 is driven according to such a roll period or roll prediction period. Of course, the angular velocity of the driving device 10 can be decided from the roll period or roll prediction period. When the prediction of roll is detected, the balance maintaining equipment 3 of the floating body may be set in a standby state based on the prediction of roll, and then operated when the roll begins. As the driving device 10 is driven, the first and second eccentric rotating bodies 20 and 30 having opposite phases are started to rotate. Since the first and second eccentric rotating bodies 20 and 30 have opposite phases, the centrifugal forces caused by the rotations of the first and second eccentric rotating bodies 20 and 30 are offset by each other, and only a moment is generated.

In this case, the moment is generated in the opposite direction to the roll of the floating body 1 caused by winds, surges, or tides. For example, when the floating body is inclined in the clockwise direction, a moment is generated in the counterclockwise direction. When the floating body is inclined in the counterclockwise direction, a moment is generated in the clockwise direction.

Furthermore, when the roll period of the floating body 1 is changed, the angular velocity of the driving shaft 13, that is, ωA and ωB may be varied to interwork with the roll period of the floating body 1. That is, when the generation period of the moment M needs to be expanded, the angular velocity of the driving shaft 13, that is, ωA and ωB may be decreased. When the generation period of the moment M needs to be reduced, the angular velocity of the driving shaft 13, that is, ωA and ωB may be increased to control the generation period. Here, ωA and ωB may have the same value.

In this case, although not illustrated in the drawing, an angular velocity control unit may be provided to vary ωA and ωB according to the change in the roll period of the floating body 1. The control unit may control the angular velocity of the driving shaft 13 such that the roll of the floating body 1 is reduced in correspondence to the inputted change data of the roll period. Such control may be achieved by controlling the driving device 10 which rotates the driving shaft 13.

Figure 4:
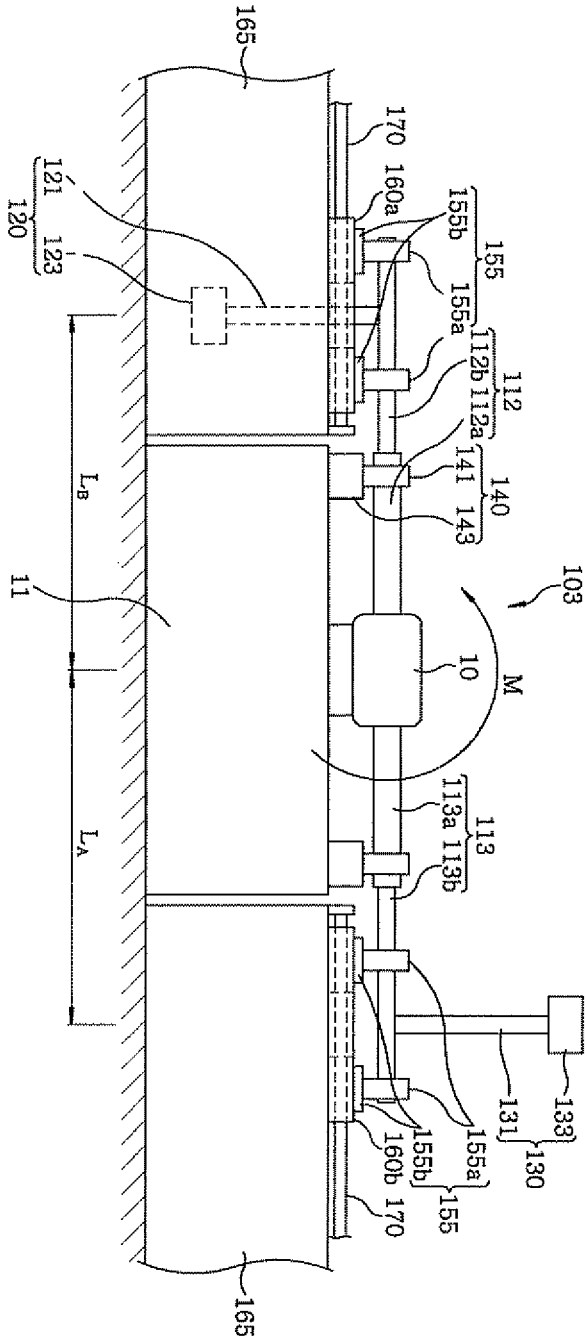
FIG. 4 is a front view of a balance maintaining equipment for a floating body in accordance with a second embodiment of the present invention.
Figure 5:
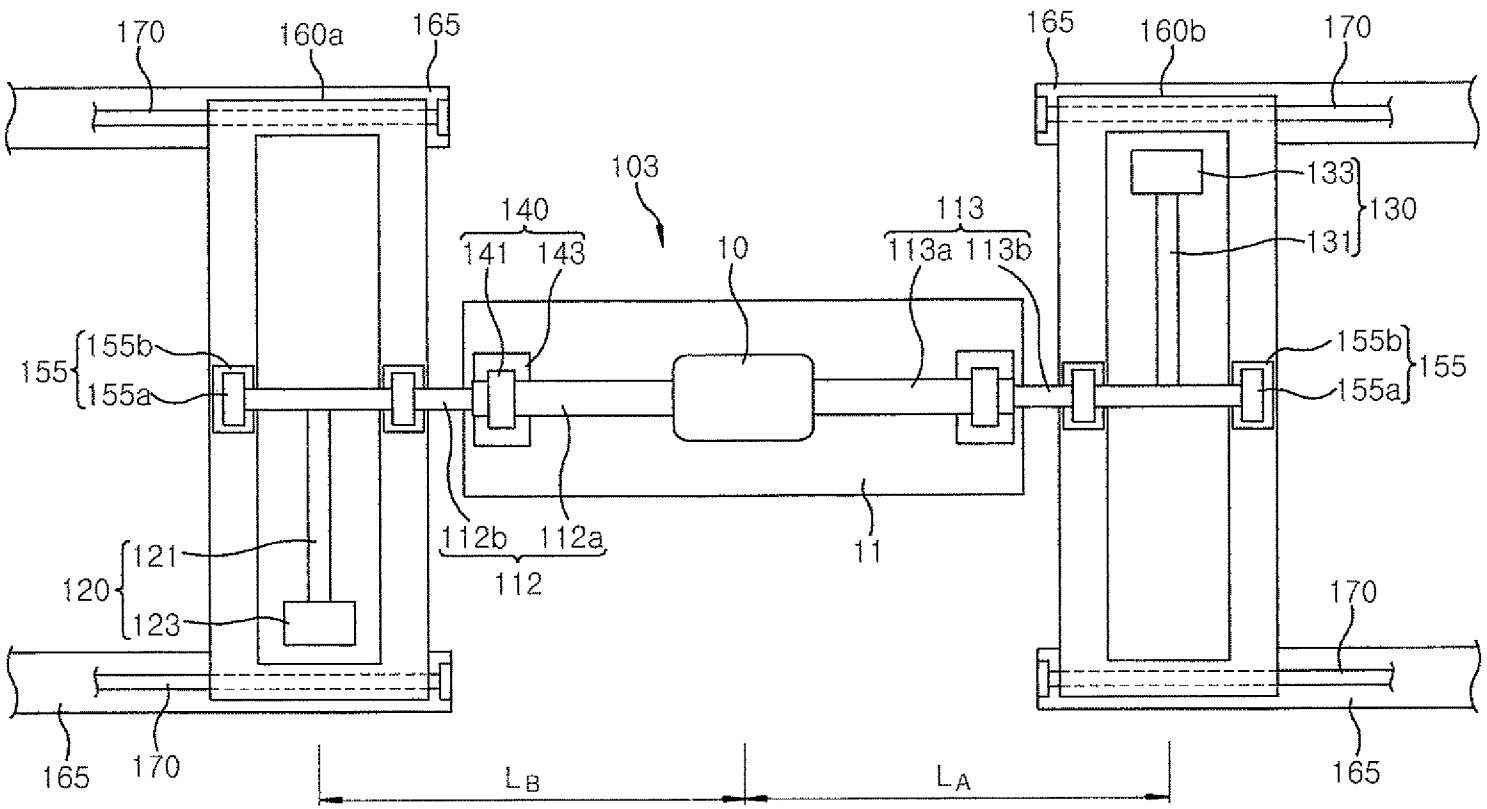
FIG. 5 is a plan view of the balance maintaining equipment of the floating body in accordance with the second embodiment of the present invention.

Referring to FIGS. 4 and 5, a balance maintaining equipment 103 of a floating body in accordance with a second embodiment of the present invention will be specifically described.

The balance maintaining equipment 103 of the floating body 103 in accordance with the second embodiment of the present invention includes a driving device 10 to rotate driving shafts 112 and 113; a first eccentric rotating body 120 which is positioned at one side of the driving shaft 112, has an end connected to the driving shaft 112, and is rotated around the driving shaft 112 by the rotation of the driving shaft 112; and a third eccentric rotating body 130 which is positioned at the other side of the driving device 10, has an end connected to the driving shaft 113, and is rotated around the driving shaft 113 while having a phase difference of 180 degrees from the rotation of the first eccentric rotating body 120. Here, the driving shafts 112 and 113 are formed to be expandable or contractible. For example, each of the driving shafts 112 and 113 may be provided by combining multi-stage shafts in which a shaft in each stage may be expanded and contracted while being advanced and retreated in the stage. FIG. 4 illustrates that the driving shafts 112 and 113 includes two-stage shafts, that is, first-stage shafts 112*a* and 113*a* and second-stage shafts 112*b* and 113*b*, respectively. However, it is understood that the driving shafts 112 and 113 may include three or more-stage shafts.

When each of the driving shafts 112 and 113 includes multi-stage shafts, the respective-stage shafts need to be rotated while interworking with each thereof. Therefore, the shafts may include spline shafts or may have a cross-sectional surface formed in a polygonal shape, such as triangle, rectangle, or pentagon. When a shaft which is directly connected to the driving device 10 is rotated, the other-stage shafts which are consecutively connected to the shaft may be rotated together. Accordingly, the rotations of the driving shafts 112 and 113 by the driving device 10 may be stably transmitted to the first and second eccentric rotating bodies 120 and 130.

In the driving shafts 112 and 113, the second-stage shafts 112*b* and 113*b* are positioned partially inside the first-stage shafts 112*a* and 113*b*, respectively, at normal times. When the driving shafts 112 and 113 need to be expanded or contracted, the second-stage shafts 112*b* and 113*b* are advanced from or retreated into the first-stage shafts 112*a* and 112*b*, respectively, to expand or contract the driving shafts. Furthermore, when the second-stage shafts 112*b* and 113*b* are advanced or retreated, the first and second eccentric rotating bodies 120 and 130 are moved together with first and second frames 160*a* and 160*b*, respectively, which will be discussed below.

The driving device 10 serves to rotate the driving shafts 112 and 113, and includes a motor, a gear body, and a decelerator, all of which are not specifically illustrated in the drawing. The driving device 10 is positioned on the platform 11, in order to secure the rotation region of the first and second eccentric rotating bodies 120 and 130.

The first and second eccentric rotating bodies 120 and 130 are provided at both sides of the driving device 10.

As used herein, the first and second eccentric rotating bodies 20 and 30 refer to include an entire set of eccentric rotating bodies which rotate around the driving shafts 112 and 113. In case where there are a plurality of eccentric rotating bodies rotating around each of the driving shafts 112 and 113 provided at one side of the driving shaft, the first and second eccentric rotating bodies 20 and 30 may be collectively included in the entire eccentric rotating bodies. Furthermore, the first eccentric rotating body 120 includes a first rotating shaft 121 and a first mass body 123, and the second eccentric rotating body 130 includes a second rotating shaft 131 and a second mass body 133.

The first eccentric rotating body 120 is positioned at one side of the driving device 10, and the second eccentric rotating body 130 is positioned at the other side of the driving device 10, that is, in the opposite side of the first eccentric rotating body 120. The first and second eccentric rotating bodies 120 and 130 may be connected to the driving shafts 112 and 113, respectively, while having a phase difference of 180 degrees. Furthermore, the first and second eccentric rotating bodies 120 and 130 may be connected perpendicular to the driving shafts 112 and 113, respectively.

The driving shafts 112 and 113 are supported by supports 140, respectively. Each of the supports 140 includes a bearing portion 141 coupled to the corresponding driving shaft and a bearing support 143.

Meanwhile, the second-stage shafts 112*b* and 113*b* of the driving shafts 112 and 113 coupled to the first and second eccentric rotating bodies 120 and 130 are rotated while being supported by the first and second frames 160*a* and 160*b*, respectively. When the second-stage shafts 112*b* and 113*b* are advanced from or retreated into the first-stage shafts 112*a* and 113*b*, respectively, the first and second eccentric rotating bodies 120 and 130 can be moved together with the first and second frames 160*a* and 160*b*, respectively. That is, the first eccentric rotating body 120 and the first frame 160*a* are provided as one unit, and the second eccentric rotating body 130 and the second frame 160*b* are also provided as one unit. The first frame 160*a* and the second frame 160*b* are formed to be moved together with the second-stage shafts 112*b* and 113*b* while coupled to the second-stage shafts 112*b* and 113*b* by supports 155, respectively, to thereby support the driving shafts 112 and 113. Accordingly, it is possible to guarantee the stability of the units with respect to the rotations of the first and second eccentric rotating bodies 120 and 130. Furthermore, the supports 155 support both sides of the second-stage shafts 112*b* and 113*b* on the basis of the first and second eccentric rotating bodies 120 and 130, respectively, and include a bearing portion 155*a* and a bearing support 155*b*.

In this embodiment, the first and second frames 160*a* and 160*b* have a hollow portion formed therein, in order to secure the rotation regions of the first and second eccentric rotating bodies 120 and 130, respectively. For example, the first and second frames 160*a* and 160*b* have a hollow portion formed in a rectangular shape ('□'). Both side end portions of the first and second frames 160*a* and 160*b* are supported by separate platforms 165. On the platforms 165, guide rails 170 are arranged to guide the first and second frames 160*a* and 160*b*, respectively. The guide rails may include a linear guide or sliding guide, and may be formed to pass through side end portions of the first and second frames 160*a* and 160*b*, respectively, such that the first and second frames 160*a* and 160*b* may be moved smoothly. It is understood that separate transfer units such as wheels or rollers may be provided on contact surfaces on which the first and second frames 160*a* and 160*b* are contacted with a platform 11.

Although not illustrated, the expansion or contraction of the driving shafts 112 and 113 by the advance or retreat of the second-stage shafts 112*b* and 113*b* from or into the first-stage shafts 112*a* and 113*a* is performed by the movements of the first and second frames 160*a* and 160*b*. More specifically, when the driving shafts 112 and 113 need to be expanded or contracted, the second-stage shafts 112*b* and 113*b* coupled to the first and second frames 160*a* and 160*b*, respectively, and the first and second eccentric rotating bodies 120 and 130 coupled to the second-stage shafts 112*b* and 113*b*, respectively, can be moved by moving the first and second frames 160*a* and 160*b*. In this regard, a variety of transfer units, for example, such as a lead screw, a rope system using a winch or a driving cylinder, may be used to move the first and second frames 160*a* and 160*b*. In this case, the transferring unit may be provided in such a manner as to transfer the first and second frames 160*a* and 160*b* in a side-to-side direction of FIG. 4.

The balance maintaining equipment 103 of the floating body in accordance with the second embodiment may be positioned inside or on the floating body 1. Further, the balance maintaining equipment 103 may be positioned in the longitudinal and/or widthwise directions of the floating body 1 depending on the roll direction of the floating body 1. In addition, a pair of balance maintaining equipments 103 may be provided in parallel to the longitudinal or widthwise directions of the floating body. Furthermore, when the balance maintaining equipments 103 are positioned in the longitudinal direction and/or widthwise direction, the balance maintaining equipments 103 may be positioned in the center of the longitudinal direction and/or widthwise direction of the floating body 1.

Furthermore, the driving shafts 112 and 113 may have strength enough to endure the centrifugal forces generated by the rotations of the first and second eccentric rotating bodies 120 and 130.

The operation of the balance maintaining equipment 103 of the floating body in accordance with the second embodiment will be described as follows.

When a roll or prediction of roll of the floating body 1 by a roll factor, for example, winds, surges, or tides is detected, the driving device 10 is driven according to such a roll period or a roll prediction period. Of course, the angular velocity of the driving device 10 can be decided from the roll period or roll prediction period. When the prediction of roll is detected, the balance maintaining equipment 103 of the floating body may be set in a standby state based on the prediction of roll, and then operated when the roll begins. As the driving device 10 is driven, the first and second eccentric rotating bodies 120 and 130 having opposite phases are started to rotate. Since the first and second eccentric rotating bodies 120 and 130 have opposite phases, the centrifugal forces caused by the rotations of the first and second eccentric rotating bodies 120 and 130 are offset by each other, and only a moment M is generated.

Furthermore, when the intensity or period of a roll factor is changed or when the weight distribution of the floating body 1 is changed by an internal cause of the floating body, in other words, when the weight distribution of the mobile harbor 1 is changed by loading or unloading the cargos 3 on or from the mobile harbor 1, the generation or generation period of the moment M needs to be changed. In this case, the generation period and magnitude of the moment M can be changed by varying ωA, ωB, LA, or LB.

When it is needed to increase the generation of the moment M, the first and second eccentric rotating bodies 120 and 130 and the first and second frames 160*a* and 160*b* housing the first and second eccentric rotating bodies are moved together to advance the second-stage shafts 112*b* and 113*b* from the first-stage shafts 112*a* and 113*b*, respectively, to increase LA and LB. On the other hand, when it is needed to decrease the generation of the moment M, the first and second eccentric rotating bodies 120 and 130 and the first and second frames 160*a* and 160*b* housing the first and second eccentric rotating bodies are moved together to retreat the second-stage shafts 112*b* and 113*b* into the first-stage shafts 112*a* and 113*a*, respectively, to thereby decrease LA and LB. Accordingly, the generation of the necessary moment M can be controlled. In case where it is required only to entirely increase or decrease the generation of the moment M, it is achieved by equalizing the increases or decreases of LA and LB with each other.

Meanwhile, when the generation period of the moment M needs to be expanded, the angular velocity of the driving shafts 112 and 113, that is, ωA and ωB are required to be reduced, and when the generation period of the moment M needs to be reduced, the angular velocity of the driving shafts 112 and 113, that is, ωA and ωB are required to be increased, thereby controlling the generation period. In this case, ωA and ωB may have the same value.

In this case, although not illustrated in the drawing, a drive shaft controlling unit may be provided to vary LA, LB, ωA, and ωB in conformity with the change in the roll period of the floating body 1. The control unit may control LA, LB, ωA, and ωB such that the roll of the floating body 1 is reduced in correspondence to the change data of the roll period to be provided thereto.

Figure 6:
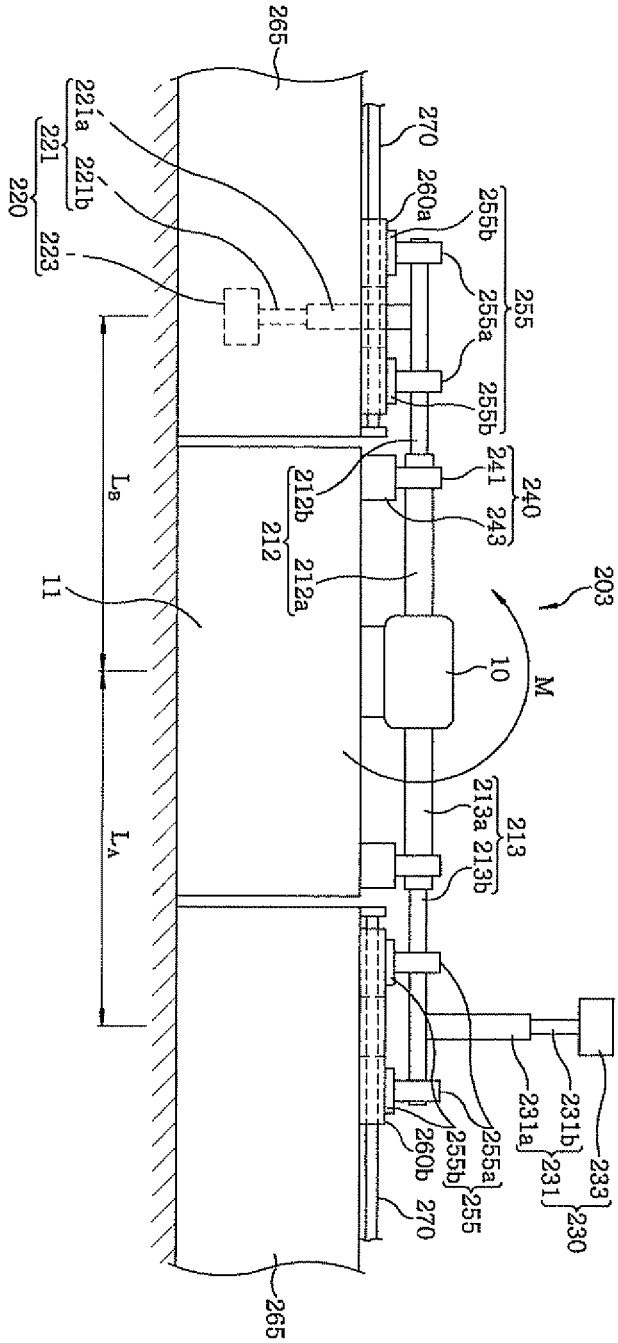
FIG. 6 is a front view of a balance maintaining equipment for a floating body in accordance with a third embodiment of the present invention.
Figure 7:
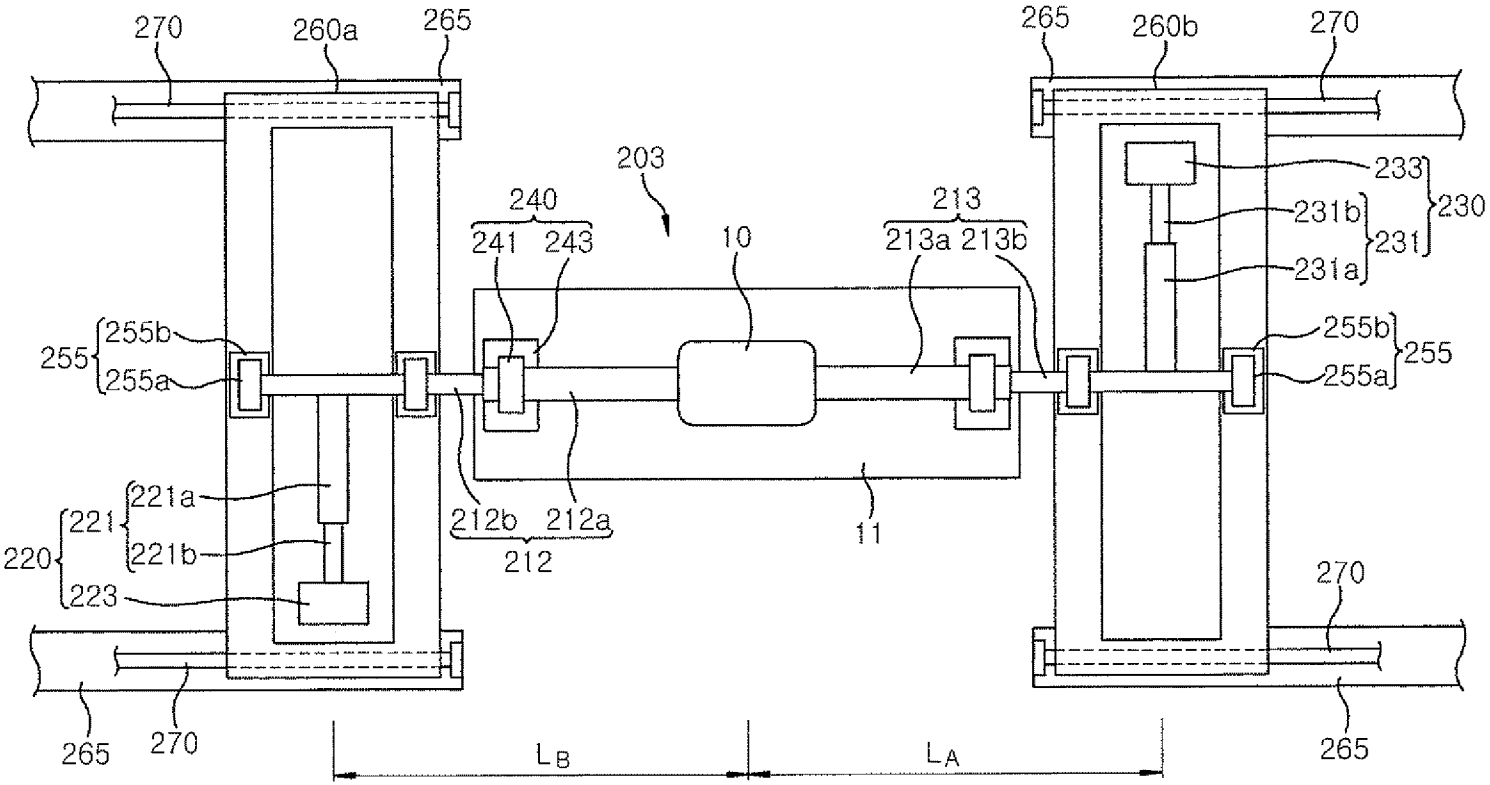
FIG. 7 is a plan view of the balance maintaining equipment of the floating body in accordance with the third embodiment of the present invention.

Referring to FIGS. 6 and 7, a balance maintaining equipment 203 in accordance with a third embodiment of the present invention will be specifically described.

The balance maintaining equipment 203 in accordance with the third embodiment includes a driving device 10 to rotate driving shafts 212 and 213; a first eccentric rotating body 220 which is positioned at one side of the driving device 10, has an end connected to the driving shaft 212, and is rotated around the driving shaft 212 by the rotation of the driving shaft 212; and a third eccentric rotating body 230 which is positioned at the other side of the driving device 10, has an end connected to the driving shaft 213, and is rotated around the driving shaft 213 while having a phase difference of 180 degrees from the rotation of the first eccentric rotating body 220. As used herein, the first and second eccentric rotating bodies 220 and 230 refer to an entire set of eccentric rotating bodies rotating around the shafts 212 and 213. The driving shafts 212 and 213 are formed to be expandable or contractible. For example, each of the driving shafts 212 and 213 may be provided by combining multi-stage shafts in which a driving shaft in each stage may be expanded and contracted while being advanced and retreated. In FIG. 6, although it has been illustrated that the driving shafts 212 and 213 includes two-stage shafts, that is, first-stage shafts 212*a* and 213*a* and second-stage shafts 212*b* and 213*b*, respectively, it is understood that they may include three or more-stage shafts.

The first eccentric rotating body 220 includes a first rotating shaft 221 and a first mass body 223, and the second eccentric rotating body 230 includes a second rotating shaft 231 and a second mass body 233. The first and second rotating shafts 221 and 231 are formed to expand and contract, and provided by combining multi-stage shafts, having different diameters, in which a rotating shaft in each stage may be expanded and contracted while being advanced and retreated. Such a first rotating shaft 221 includes a first-stage shaft 221*a* and a second-stage shaft 221*b*, and the second rotating shaft 231 includes a first-stage shaft 231*a* and a second-stage shaft 231*b*. In the third embodiment of the present invention, each of the first and second rotating shafts 221 and 231 includes two-stage shafts, however, the rotating shaft may include three or more-stage shafts.

In addition, when each of the driving shafts 212 and 213 includes multi-stage shafts, the respective-stage shafts need to be rotated while interworking with each thereof. Therefore, the shafts in each stage may be implemented as spline shafts or may have a cross-sectional surface formed in a polygonal shape, such as triangle, rectangle, or pentagon. When a shaft which is directly connected to the driving device 10 is rotated, the other-stage shafts which are consecutively connected to the shaft may be rotated together. Accordingly, the rotations of the driving shafts 112 and 113 by the driving device 10 may be stably transmitted to the first and second eccentric rotating bodies 120 and 130.

In the first rotating shaft 221, the second-stage shaft 221*b* is positioned partially or entirely inside the first-stage shaft 221*a* at normal times. When the first-stage rotating shaft 221 needs to be expanded or contracted, the second shaft 221*b* is advanced from or retreated into the first-stage shaft 221*a* to expand or contract the first rotating shaft 221. In this regard, when the second-stage shaft 221*b* is advanced from the first-stage shaft 221*a*, the advance of the second-stage shaft 221*b* is limited by the internal space of a first frame 260*a*. The advance or retreat of the second-stage shaft 221*b* from or into the first-stage shaft 221*a* may be performed by a separate driver (not shown) positioned inside the first-stage shaft 221*a*. However, the driver may be positioned outside the first-stage shaft 221*a*, and controlled in a wireless manner. In addition, the retreat of the second-stage shaft 221*b* into the first-stage shaft 221*a* in the first rotating shaft 221 may be performed by a reverse operation of the driver.

In the second rotating shaft 231, the second-stage shaft 231*b* is also partially or entirely advanced from or retreated into the first-stage shaft 231*a* to expand or contract the second rotating shaft 231, similar to the first rotating shaft 221. Specific descriptions thereof are the same as those of the first rotating shaft 221, and thus are omitted herein.

In the driving shaft 212, the second-stage shaft 212*b* is positioned partially inside the first-stage shaft 212*a* at normal times. When the driving shaft 212 needs to be expanded or contracted, the second-stage shaft 212*b* is advanced from or retreated into the first-stage shaft 212*a* to expand or contract the driving shaft 212. In the driving shaft 213, the same operation is performed. When the second-stage shafts 212*b* and 213*b* are advanced or retreated, the first and second eccentric rotating bodies 220 and 230 can be moved together with the first and second frames 260*a* and 260*b*, which will be disclosed below.

Here, the driving device 10 serves to rotate the driving shafts 212 and 213, and is positioned on the platform 11 in order to secure the rotation regions of the first and second eccentric rotating bodies 220 and 230. The first and second eccentric rotating bodies 220 and 230 are provided at both sides of the driving device 10.

The first eccentric rotating body 220 is positioned at one side of the driving device 10, and the second eccentric rotating body 230 is positioned at the other side of the driving device 10, that is, in the opposite side of the first eccentric rotating body 220. The first and second eccentric rotating bodies 220 and 230 are connected to end portions of the driving shafts 212 and 213, respectively, while having a phase difference of 180 degrees from each other. In this case, the first and second eccentric rotating bodies 220 and 230 may be fixed to the driving shafts 212 and 213, respectively, to maintain a phase difference of 180 degrees from each other. Furthermore, the first and second eccentric rotating bodies 220 and 230 may be connected perpendicular to the driving shafts 212 and 213, respectively.

The driving shafts 212 and 213 is supported by supports 240, and each of the support 240 includes a bearing portion 241 coupled to the driving shaft 213 and a bearing support 243.

Meanwhile, the first and second eccentric rotating bodies 220 and 230 are rotated while supported by the first and second frames 260*a* and 260*b*, respectively. When the second-stage shafts 212*b* and 213*b* are advanced from or retreated into the first-stage shafts 212*a* and 213*a*, the first and second eccentric rotating bodies 220 and 230 are moved along with the first and second frames 260*a* and 260*b*, respectively. That is, the first eccentric rotating body 220 and the first frame 260*a*, and the second eccentric rotating body 230 and the second frame 260*b* are provided as one unit, respectively. The first and second frames 260*a* and 260*b* are formed to move together with the second shafts 212*b* and 213*b* while coupled to the second shafts 212*b* and 213*b* through supports 255, respectively, to thereby support the driving shafts 212 and 213. Therefore, it is possible to guarantee the stability of the units with respect to the rotations of the first and second eccentric rotating bodies 220 and 230. In this case, the supports 255 support both sides of the second shafts 212*b* and 213*b* on the basis of the first and second eccentric rotating shafts 220 and 230, respectively, and include a bearing portion 255*a* and a bearing support 255*b*.

In this embodiment, the first and second frames 260*a* and 260*b* may have a hollow portion formed therein, in order to secure the rotation regions of the first and second eccentric rotating bodies 220 and 230, respectively. For example, the first and second frames 260*a* and 260*b* may have a hollow portion formed in a rectangular shape ('□'). Both side end portions of the first and second frames 260*a* and 260*b* may be supported by separate platforms 265.

In this case, guide rails 270 are arranged on the platforms 265, respectively, to guide the first and second frames 260*a* and 260*b*. The guide rails 270 may include a linear guide or sliding guide, and may be formed to pass through side end portions of the first and second frames 260*a* and 260*b*, respectively, such that the first and second frames 260*a* and 260*b* may move smoothly. It is understood by those skilled in the art that separate transfer units such as wheels or rollers may be provided on contact surfaces on which the first and second frames 260*a* and 260*b* are contacted with a platform 11.

Although not illustrated, the expansion or contraction of the driving shafts 212 and 213 by the advance or retreat of the second shafts 212*b* and 213*b* from or into the first-stage shafts 212*a* and 213*a* may be performed by the movements of the first and second frames 260*a* and 260*b*, respectively. More specifically, when the driving shafts 212 and 213 need to be expanded or contracted, the second-stage shafts 212*b* and 213*b* coupled to the first and second frames 260*a* and 260*b*, respectively, and the first and second eccentric rotating bodies 220 and 230 coupled to the second shafts 212*b* and 213*b*, respectively, can be moved by moving the first and second frames 260*a* and 260*b*. In this regard, a variety of transfer units, for example, such as a lead screw, a rope system using a winch, or a driving cylinder, may be used to move the first and second frames 260*a* and 260*b*. In this case, the transfer unit may be provided in such a manner as to move the first and second frames 260*a* and 260*b* in a side-to-side direction of FIG. 6.

The balance maintaining equipment 203 of the floating body in accordance with the third embodiment may be positioned inside or on the mobile harbor 1. Further, the balance maintaining equipment 203 may be positioned in the longitudinal direction and/or widthwise direction of the mobile harbor 1 depending on the roll direction of the mobile harbor 1. In addition, a pair of balance maintaining equipments 203 of the floating body may be provided in parallel to the longitudinal or widthwise direction. Furthermore, when the balance maintaining equipments 103 are positioned in the longitudinal direction and/or widthwise direction, the balance maintaining equipments 203 may be positioned in the center of the longitudinal direction and/or widthwise direction of the floating body 1.

Furthermore, the driving shafts 212 and 213 may have strength enough to endure the centrifugal forces generated by the rotations of the first and second eccentric rotating bodies 220 and 230.

The operation of the balance maintaining equipment 203 of the floating body in accordance with the third embodiment will be described as follows.

When a roll or prediction of roll of the floating body 1 by a roll factor, for example, winds, surges, or tides is detected, the driving device 10 is driven according to such a roll period or roll prediction period. Here, the angular velocity of the driving device 10 can be decided from the roll period or roll prediction period. When the prediction of roll is detected, the balance maintaining equipment 203 of the floating body may be set in a standby state based on the prediction of roll, and then operated when the roll begins. As the driving device 10 is driven, the first and second eccentric rotating bodies 220 and 230 having opposite phases are started to rotate. The centrifugal forces caused by the rotations of the first and second eccentric rotating bodies 220 and 230 are then offset by each other, and only a moment M is generated.

Furthermore, when the intensity or period of a roll factor is changed or when the weight distribution of the floating body 1 is changed by an internal cause of the floating body, for example, when the weight distribution of the mobile harbor 1 is changed by loading or unloading the cargos 3 on or from the mobile harbor 1, the generation or generation period of the moment M needs to be changed. In this case, the generation period and magnitude of the moment M can be changed by varying ωA, ωB, rA, rB, LA, or LB.

When the generation of the moment M is to be increased, the first and second eccentric rotating bodies 220 and 230 and the first and second frames 260*a* and 260*b* housing them, are moved together to advance the second-stage shafts 212*b* and 213*b* from the first-stage shafts 212*a* and 213*b*, respectively. Alternatively, the second-stage shaft 221*b* of the first eccentric rotating body and the second-stage shaft 231*b* of the second eccentric rotating body may be advanced from the first-stage shaft 221*a* of the first eccentric rotating body and the first-stage shaft 231*a* of the second eccentric rotating body, respectively. Then, LA or LB is partially or entirely increased, or rA or rB is partially or entirely increased, thereby increasing the generation of the moment M. On the contrary, when the generation of the moment M is to be reduced, the first and second eccentric rotating bodies 220 and 230 and the first and second frames 260*a* and 260*b* housing them may be moved together to retreat the second-stage shafts 212*b* and 213*b* into the first-stage shafts 212*a* and 213*a*, respectively. Alternatively, the second-stage shaft 221*b* of the first eccentric rotating body and the second shaft 231*b* of the second eccentric rotating body may be retreated into the first-stage shaft 221*a* of the first eccentric rotating body and the first-stage shaft 231*a* of the second eccentric rotating body, respectively. Then, LA or LB is partially or entirely decreased, or rA or rB is partially or entirely decreased, to thereby reduce the generation of the moment M. In case where it is required only to entirely increase or reduce the generation of the moment M, it is achieved by equalizing the increases or decreases of LA and LB with each other, or the increases or decreases of rA and rB with each other. Alternatively, it is understood that all of rA, rB, LA, and LB may be varied to increase or reduce the generation of the moment M.

Meanwhile, when the generation period of the moment M needs to be expanded, the angular velocity of the driving shafts 212 and 213, that is, ωA and ωB are required to be decreased, and when the generation period of the moment M needs to be reduced, the angular velocity of the driving shafts 112 and 113, that is, ωA and ωB are required to be increased, thereby controlling the generation period. In this case, ωA and ωB may have the same value.

In this case, although not illustrated in the drawing, a shaft control unit may be provided to vary rA, rB, LA, LB, ωA, and ωB in conformity with the change in the roll period of the floating body 1. The control unit may control rA, rB, LA, LB, ωA, and ωB such that the roll of the mobile harbor 1 is reduced in correspondence to the change data of the roll period to be provided thereto.

Figure 8:
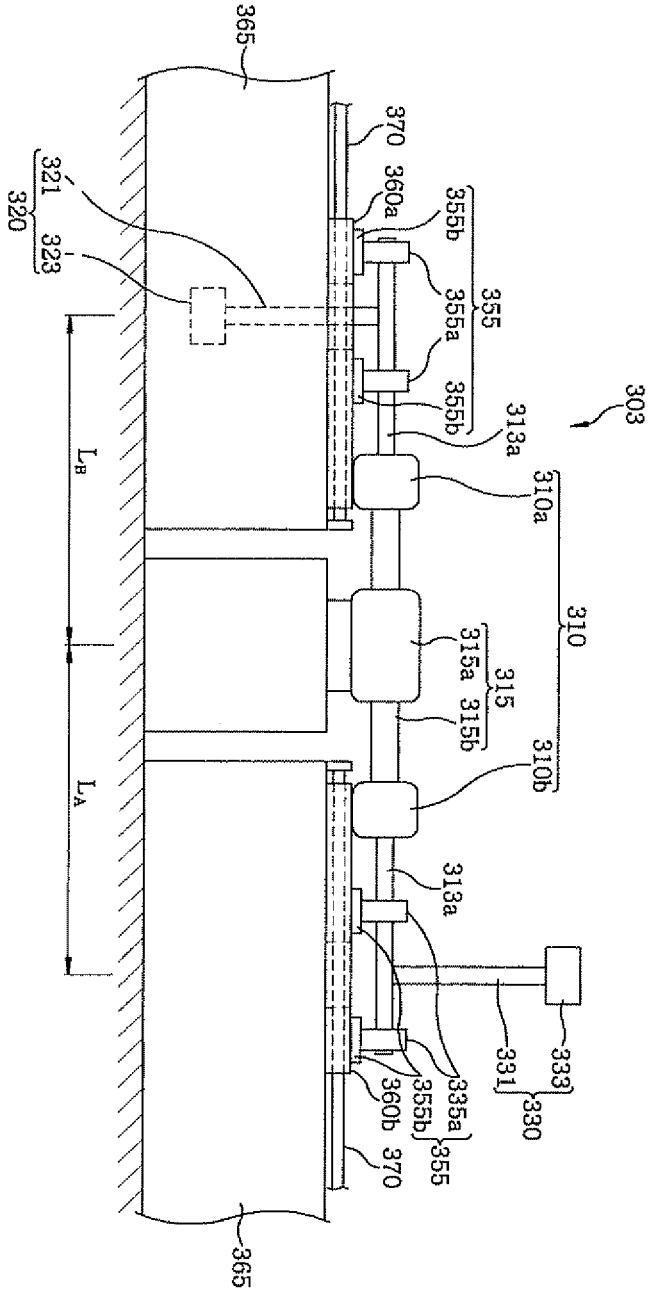
FIG. 8 is a front view of a balance maintaining equipment for a floating body in accordance with a fourth embodiment of the present invention.

Referring to FIG. 8, a balance maintaining equipment 303 in accordance with a fourth embodiment of the present invention will be described in detail. Hereinafter, the detailed descriptions of the same components as those of the balance maintaining equipment of the floating body in accordance with the first to third embodiments of the present invention will be omitted.

The balance maintaining equipment 303 in accordance with the fourth embodiment includes a driving device 310 having two driving devices, i.e., first and second driving devices 310*a* and 310*b* which serve to rotate first and second driving shafts 313*a* and 313*b*, respectively. The balance maintaining equipment further includes a first eccentric rotating body 320 which is positioned at one side of the driving device 310, has one end connected to the first driving shaft 313*a*, and is rotated around the first driving shaft 313*a* by the rotation of the first driving shaft 313*a*; and a second eccentric rotating body 330 which is positioned at the other side of the driving device 310, has one end connected to the second driving shaft 313*b*, and is rotated around the second driving shaft 313*b*, wherein the rotation of the second eccentric rotating body 330 has a phase difference of 180 degrees from the rotation of the first eccentric rotating body 320. The first eccentric rotating body 320 includes a first rotating shaft 321 and a first mass body 323, and the second eccentric rotating body 330 includes a second rotating shaft 331 and a second mass body 333.

The driving device 310 serves to rotate the driving shafts 313*a* and 313*b*. The driving device 310 may include a motor and a gear body which are not illustrated, and may be implemented with any devices capable of driving the driving shafts 313*a* and 313*b*. Furthermore, the driving device 310 may include a decelerator (not illustrated) which serves to reduce the number of rotations by the motor or the like.

The driving device 310 are provided for the first and second driving shafts 313*a* and 313*b*, so that the first driving shaft 313*a* can be rotated by the first driving device 310*a*, and the second driving shaft 313*b* may be rotated by the second driving device 310*b*.

Further, the balance maintaining equipment 303 include a transferring device 315 which transfers the first driving device 310*a* and the first eccentric rotating body 320; and the second driving device 310*b* and the second eccentric rotating body 330.

The first driving device 310*a* and the first eccentric rotating body 320 are supported in the first frame 360*a* to form a first unit 310*a*, 320, and 360*a*, and the second driving device 310*b* and the second eccentric rotating body 330 are supported in the second frame 360*b* to form a second unit 310*b*, 330, and 360*b*. Specifically, the first driving device 310*a* is coupled to a first frame 360*a*, and the first driving shaft 313*a* rotated by the first driving device 310*a* is coupled to the first eccentric rotating body 320, and simultaneously coupled to supports 355 mounted to the first frame 360*a*. Each of the supports 355 includes a bearing unit 355*a* and a bearing support 355*b*. The first and second frames 360*a* and 360*b* have a hollow portion formed in a rectangular shape ('□'), in order to secure the rotation regions of the first and second eccentric rotating bodies 320 and 330.

The transferring device 315 moves the first unit 310*a*, 320, and 360*a* and the second unit 310*b*, 330, and 360*b*. The transferring device 315 is connected to the first and second frames 360*a* and 360*b*, or is connected to the first and second driving devices 310*a* and 310*b*.

The transferring device 315 includes a shaft driver 315*a* providing a driving force for moving the first and second frames 360*a* and 360*b*, and a shaft 315*b* transmitting such a driving force. In such a transferring device 315, the shaft 315*b* may include a cylinder, and the shaft driver 315*a* may include a unit for supplying pressure to the cylinder. Without being limited thereto, various devices such as a lead screw or a rope system using a winch may be utilized.

The side end portions of the first and second frames 360*a* and 360*b* are supported by separate platforms 365. On the platforms 365, guide rails 370 are arranged in such a manner that the first and second frames 360*a* and 360*b* are smoothly moved by the transferring device 315.

The guide rails 370 are formed to pass through the side end portions of the first and second frames 360*a* and 360*b*, and separate transferring units such as wheels or rollers may be provided on contact surfaces on which the first and second frames 360*a* and 360*h* are contacted with the platform 365.

The operation of the balance maintaining equipment 303 of the floating body in accordance with the fourth embodiment will be described as follows.

When a roll or prediction of roll of the floating body 1 by a roll factor, for example, winds, surges, or tides is detected, the driving device 310 is driven according to the roll period or roll prediction period. Of course, the angular velocity of the driving device 310 can be decided from the roll period or roll prediction period. When the prediction of roll is detected, the balance maintaining equipment 403 of the floating body may be set in a standby state based on the prediction of roll, and then operated when the roll begins. As the driving device 310 is driven, rotations of the first and second eccentric rotating bodies 320 and 330 having opposite phases are started to rotate, wherein the first and second eccentric rotating bodies 320 and 330 are fixed to the driving shafts 313*a* and 313*b*, respectively, while having a phase difference of 180 degrees from each other. Since the first and second eccentric rotating bodies 320 and 330 have opposite phases, the centrifugal forces caused by the rotations of the first and second eccentric rotating bodies 320 and 330 are offset by each other, and only a moment M is generated.

In this case, the moment is generated in the opposite direction to the roll of the floating body 1. For example, when the floating body is inclined in the clockwise direction, a moment is generated in the counterclockwise direction. When the floating body is inclined in the counterclockwise direction, a moment is generated in the clockwise direction.

Furthermore, when the intensity or period of the roll factor is changed or when the weight distribution of the floating body 1 is changed by an internal cause of the floating body, for example, when the weight distribution of the mobile harbor 1 is changed by loading or unloading the cargos 3 (see FIG. 1) on or from the mobile harbor 1, the generation or generation period of the moment M needs to be changed. In this case, the generation and the generation period of the moment M can be changed by varying ωA, ωB, LA, or LB. The variation of LA or LB is performed by the movement of the first or second unit caused by the operation of the shaft driver 315*a*, and ωA and ωB is controlled by changing the angular velocity of the driving shafts 313*a* and 313*b*. Furthermore, a control unit for varying ωA, ωB, LA, or LB may be provided, similar to the above-described embodiments.

While various embodiments of the balance maintaining equipment of the floating body of the present invention have been described above, it should be understood that they have been presented by way of example only, and not limitation. It will be understood by those skilled in the art that various changes in form and details may be made therein without departing from the scope of the invention as defined in the appended claims. Thus, the breadth and scope of the present invention should not be limited by any of the above-described exemplary embodiments, but should be defined in accordance with the following claims and their equivalents.

The invention claimed is:

1. A balance maintaining equipment for a floating body, comprising:

a driving device for rotating a driving shaft;

a first eccentric rotating body positioned at one side of the driving device, connected to the driving shaft, and rotated around the driving shaft by the rotation of the driving shaft; and a second eccentric rotating body positioned at the other side of the driving device, connected to the driving shaft, and rotated around the driving shaft by the rotation of the driving shaft while having a phase difference of 180 degrees from the rotation of the first eccentric rotating body, wherein the driving shaft is formed to expand or contract in a direction from the one side to the other side or from the other side to the one side to increase or decrease a moment which is generated by the rotation of the first eccentric rotating body and second eccentric rotating body.

2. The balance maintaining equipment of claim 1, wherein the driving shaft is formed by combining multi-stage shafts having different diameters, wherein a shaft in each stage is expanded or contracted while being advanced or retreated in the stage.

3. The balance maintaining equipment of claim 2, wherein the shafts in the respective stages include a spline shaft or a shaft having a cross-sectional surface formed in a polygonal shape.

4. The balance maintaining equipment of any one of claim 1, when the driving shaft is expanded or contracted, the length of the driving shaft expanded or contacted in the direction of the one side is equal to that of the driving shaft expanded or contracted in the direction of the other side.

5. The balance maintaining equipment of claim 2, further comprising:

a first frame having a rotation region of the first eccentric rotating body, supporting the one-side of the driving shaft, and moved together with the shaft of the driving shaft when the driving shaft is expanded or contracted; and a second frame having a rotation region of the second eccentric rotating body, supporting the other-side of the driving shaft, and moved together with the shaft of the driving shaft when the driving shaft is expanded or contracted.

6. The balance maintaining equipment of claim 5, further comprising guide rails for guiding the first and second frames, respectively, wherein the first and second frames are formed to move along the guide rails, respectively.

7. The balance maintaining equipment of claim 1, wherein the first and second eccentric rotating bodies include, first and second rotating shafts having one ends coupled to the driving shaft, respectively, and first and second mass bodies coupled to the other ends of the first and second rotating shafts, respectively.

8. The balance maintaining equipment of claim 7, wherein each of the first and second rotating shafts is formed by combining multi-stage shafts having different diameters, wherein a shaft in each stage is expanded and contracted.

9. A balance maintaining equipment for a floating body, comprising:

a first driving device for rotating a first driving shaft;

a first eccentric rotating body positioned at one side of the first driving device, having one end connected to the first driving shaft, and rotated around the first driving shaft by the rotation of the first driving shaft;

a second driving device for rotating a second driving shaft;

a second eccentric rotating body positioned at the other side of the second driving device, having one end connected to the second driving shaft, and rotated around the second driving shaft by the rotation of the second driving shaft while having a phase difference of 180 degrees from the rotation of the first eccentric rotating body;

a first frame for housing and supporting the first driving device and the first driving shaft;

a second frame for housing and supporting the second driving device and the second driving shaft; and a transferring device for transferring the first and second frames in a direction perpendicular to a plane along which the first and second eccentric rotating shafts are rotated.

10. The balance maintaining equipment of claim 9, further comprising guide rails for guiding the first and second frames, respectively, wherein the first and second frames are moved along the guide rails, respectively.

11. The balance maintaining equipment of claim 9, wherein, when the first and second driving devices are transferred by the transferring device, the transfer distances of the first and second driving devices are equal to each other.

12. A balance maintaining equipment for a floating body, comprising:

a first driving device for rotating a first driving shaft;

a first eccentric rotating body positioned at one side of the first driving device, having one end connected to the first driving shaft, and rotated around the first driving shaft by the rotation of the first driving shaft;

a second driving device for rotating a second driving shaft; and a second eccentric rotating body positioned at the other side of the second driving device, having one end connected to the second driving shaft, and rotated around the second driving shaft by the rotation of the second driving shaft while having a phase difference of 180 degrees from the rotation of the first eccentric rotating body, wherein the first and second eccentric rotating bodies include, first and second rotating shafts having one ends coupled to the first and second driving shafts, respectively, and first and second mass bodies coupled to the other ends of the first and second rotating shafts, respectively.

13. The balance maintaining equipment of claim 2, when the driving shaft is expanded or contracted, the length of the driving shaft expanded or contacted in the direction of the one side is equal to that of the driving shaft expanded or contracted in the direction of the other side.

14. The balance maintaining equipment of claim 3, when the driving shaft is expanded or contracted, the length of the driving shaft expanded or contacted in the direction of the one side is equal to that of the driving shaft expanded or contracted in the direction of the other side.

* * * * *